United States Patent [19]

Vural et al.

[11] 4,348,901

[45] Sep. 14, 1982

[54] APPARATUS FOR MONITORING THE DEGREE OF COMPACTION

[75] Inventors: Gülertan Vural, Emmelshausen; Uwe Blancke, Koblenz, both of Fed. Rep. of Germany

[73] Assignee: Koehring GmbH-BOMAG Division, Boppard, Fed. Rep. of Germany

[21] Appl. No.: 198,266

[22] Filed: Oct. 17, 1980

[30] Foreign Application Priority Data

Oct. 19, 1979 [DE] Fed. Rep. of Germany ..... 2942334

[51] Int. Cl.[3] ..... G01N 3/36; E01C 19/34

[52] U.S. Cl. ..... 73/594; 73/84; 404/133

[58] Field of Search ..... 73/84, 573, 594, 784, 73/813; 404/72, 117, 133

[56] References Cited

U.S. PATENT DOCUMENTS 4,040,292 8/1977 Theurer et al. ..... 73/84

4,103,554 8/1978 Thurner ..... 73/573

4,127,351 11/1978 Vural ..... 404/133 X

*Primary Examiner*—Charles A. Ruehl

*Attorney, Agent, or Firm*—Spencer & Kaye

[57] ABSTRACT

In apparatus for monitoring the degree of compaction achieved by a compacting device including at least one vibrating compacting tool which device is mounted on a vehicle arranged to travel back and forth over a surface to be compacted, the apparatus including a system for detecting the value of an operating parameter which has a known relationship to the effective power of the vibrating compacting tool during each pass of the vehicle over the surface and which is representative of the degree of compaction achieved, there are further provided a representation storage system connected to the detecting system for separately storing representations of the detected values associated with each direction of travel of the vehicle, and a difference forming unit connected to the storage system for providing a representation of the difference between detected values associated with successive passes of the vehicle in the same direction.

10 Claims, 1 Drawing Figure

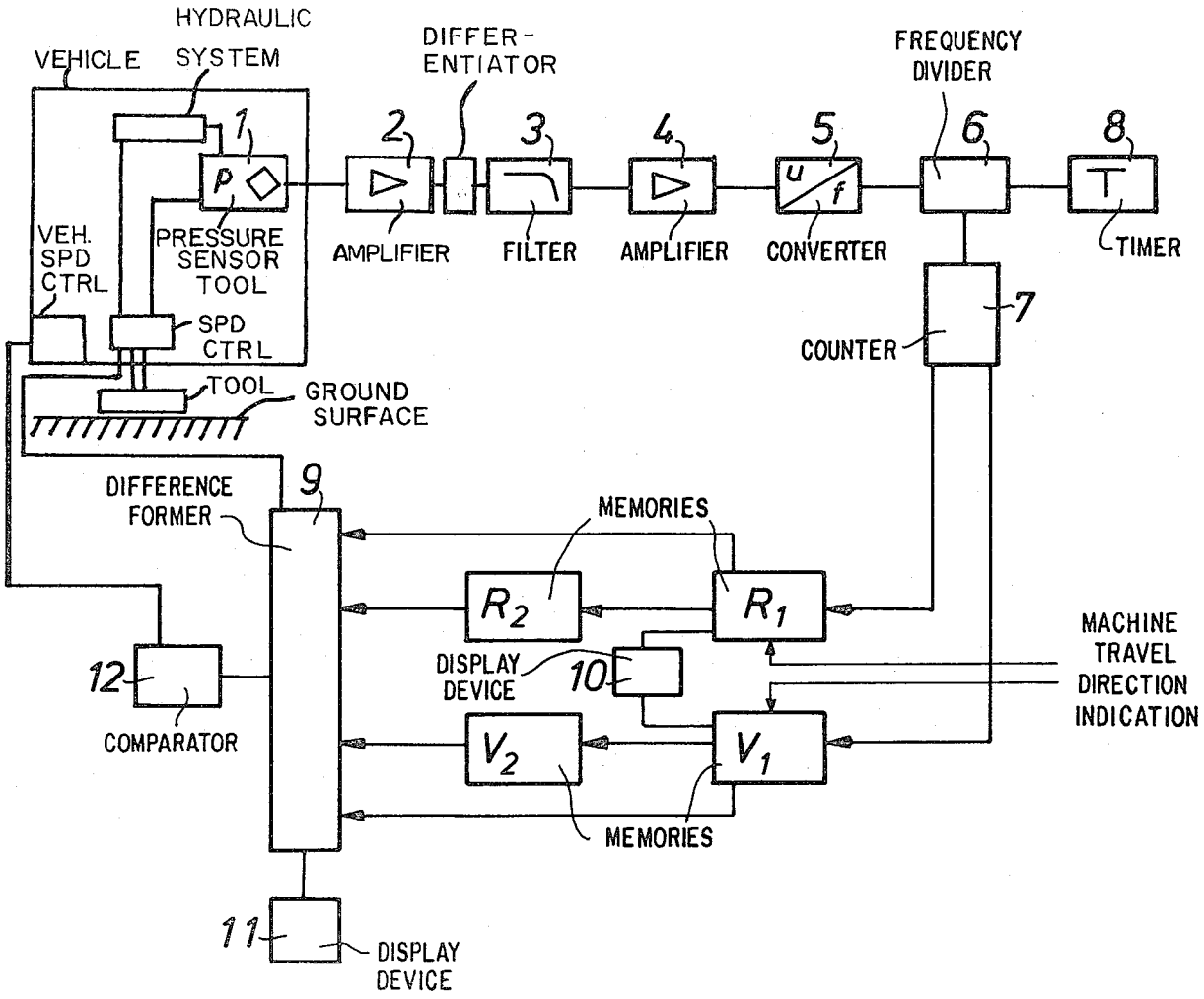
HYDRAULIC SYSTEM
VEHICLE
1
P
PRESSURE SENSOR TOOL
2
AMPLIFIER
DIFFER-ENTIATOR
3
FILTER
4
AMPLIFIER
5
u
f
CONVERTER
FREQUENCY DIVIDER
6
8
T
TIMER
7
COUNTER
VEH. SPD CTRL
SPD CTRL
TOOL
GROUND SURFACE
9
DIFFERENCE FORMER
MACHINE TRAVEL DIRECTION INDICATION
R1
R2
V1
V2
MEMORIES
MEMORIES
10
DISPLAY DEVICE
12
COMPARATOR
11
DISPLAY DEVICE

APPARATUS FOR MONITORING THE DEGREE OF COMPACTION

BACKGROUND OF THE INVENTION

The present invention relates to an apparatus for monitoring the degree of compaction achieved by mobile soil compacting devices of the type including at least one vibrating compacting tool, wherein a measured value which has a known relationship to the effective power of the vibratory compacting tool is sensed and stored as a measure for the degree of compaction.

U.S. Pat. No. 4,127,351 discloses the use, instead of physical characteristics of the soil itself, of a value which can be measured directly at the compacting device as an indication of the effective power actually applied to the soil as well as indication of the actual degree of compaction imparted to the soil. Any value which has a fixed relationship to the effective power of the compacting tool can be used as such a parameter, for example the driving power of the compacting tool minus the reactive power component consumed within the system itself, i.e. in hydraulically driven compacting tools the hydraulic pressure minus the pressure component consumed as reactive power. In compacting systems employing a plurality of independently operated compacting tools, the soil settlement derived from the difference in height of the individual tools is particularly suitable.

These measured values have been found to be very satisfactory in the determination of the amplitude variation in the sense of maximum compacting performance as disclosed in the above-mentioned patent. However, in a number of compacting devices measurement of these values often does not permit accurate conclusions to be drawn regarding the corresponding actual degree of compaction of the soil so that it cannot be determined whether it would be worthwhile to perform further passes with the compacting device or whether such passes would be superfluous or even result in renewed loosening of the soil at the surface.

SUMMARY OF THE INVENTION

It is therefore an object of the present invention to provide more accurate information regarding the degree of compaction realized in a manner which can be applied with equal success to the most varied configurations of mobile dynamic compacting devices.

These and other objects are achieved, according to the invention, in apparatus for monitoring the degree of compaction achieved by a compacting device including at least one vibrating compacting tool which device is mounted on a vehicle arranged to travel back and forth over a surface to be compacted, the apparatus including means for detecting the value of an operating parameter which has a known relationship to the effective power of the vibrating compacting tool during each pass of the vehicle over the surface and which is representative of the degree of compaction achieved, by the provision of representation storage means connected to the detecting means for separately storing representations of the detected values associated with each direction of travel of the vehicle, and difference forming means connected to the storage means for providing a representation of the difference between detected values associated with successive passes of the vehicle in the same direction.

The present invention is based on the realization that the effective power actually introduced into the soil is subject to fluctuations even if the operating parameters, e.g. vibratory mass, vibration frequency, vibration amplitude and duration of compaction, are kept constant and also if the soil consistency does not change and that these fluctuations are due, at least in part, to the asymmetry of the compacting tool. The magnitude of these fluctuations depends on the direction in which the compacting device is being guided over the soil to be compacted. There thus results, in spite of constant operating characteristics, a slightly different effective power for forward movement of the compacting device than for reverse movement. This difference, caused by such asymmetry, occurs in compacting devices having only one compacting tool, for example a plate vibrator, as well as in devices having a plurality of independently operating compacting tools.

Applicants have now found that this difference is the reason that a comparison of results from immediately successive passes in opposite directions will not provide an accurate decision criterion as to when the optimum compaction of the soil has been realized. Therefore, according to the invention, the measured values obtained during forward movements are monitored separately from those obtained during reverse movements and only those measured values are compared which are associated with the same direction of movement of the compacting tool.

According to further embodiments of the present invention, the differences of successive measured values for the same direction of movement are determined by providing each of the two memories associated with the different directions of movement with its own preliminary memory for the measured values of the new pass and a subsequent memory for the measured values from the preceding pass. To keep the memory capacity as small as possible it is particularly favorable if the read-in of a new measured value causes the measured values in the subsequent memory to be erased and the measured values then stored in the preliminary memory to be transferred to the subsequent memory. In this way, only those measured values remain in the memory which must be known in order to form a difference with the new measured value, whereas the measured values from older passes are erased at the earliest possible time.

To simplify operation of the compacting tool it is of advantage to feed representations of the difference between measured values of successive passes in the same direction of movement to a comparator which emits a signal when a given minimum difference value is not reached. This indicates to the operator that further use of the device is no longer worthwhile and continued compaction may lead to loosening the soil again.

There further exists the possibility of automatically increasing the speed of movement of the compacting tool when the given minimum value is not being reached and to thus reduce the compacting power introduced into the soil per unit distance of machine travel. This increase in speed can advisably be controlled by a regulator in such a way that the speed is set to the value at which the difference between measured values for successive passes in the same direction of movement approximately corresponds to the given minimum value.

There also exists the advantageous possibility of maximizing the difference between measured values of successive passes in the same direction of movement in a manner known per se by varying the amplitude of movement of the compacting tool as disclosed in U.S. Pat. No. 4,127,351.

It lies within the scope of the present invention to measure and process the values representative for the effective power either constantly over the entire length of a pass or instead only for a short portion of this length at the beginning of each new pass. In principle it is advisable, in this connection, to effect measurements over a certain length of path or time, instead of deriving a single momentary measured value, to compile the associated measured value curve and to feed it into a simple computer for forming the integral measured value average. This removes the influence of unavoidable local fluctuations in the measured values.

The measured value representative for the effective power may be obtained in various ways. For example, the driving power can be measured by monitoring the torque and the rate of rotation of the comparator drive and, by adding on an interference value, by deducting therefrom an indication of the reactive power consumed in the system itself. The reactive power can be measured in a simple way by lifting the frame holding the compacting tools and then measuring the power consumed in the system itself in dependence on the operating parameters, i.e. mainly in dependence on the vibration amplitude and the vibration frequency. The reactive power is then known for all applicable operating parameters and can be subtracted by a computer from the measured driving power.

Usually compacting tools are driven hydraulically. In this case it is particularly advisable to have the hydraulic pressure operate as the measured value, here again under consideration of the pressure component consumed as reactive power in the system itself, which can be measured in the same manner as described above.

For compacting devices which operate with unchanging operating parameters, separate consideration of the reactive power can of course be omitted since the reactive power is constant and is cancelled out in the difference formation of the measured values.

Regarding the technology for processing the measured value, it is advisable, due to the particularly high requirements for accuracy in the measured values which change from pass to pass, to include in the processing chain a measured value sensor, an amplifier, a differentiator, a lowpass filter, a matching amplifier, a voltage/frequency converter, a divider, a counter, memories associated with the different directions of movement and a difference former. Additionally, the processing chain may include a differentiator which excludes from storage momentary fluctuations in the measured values insofar as they lie outside of a given fluctuation range. The individual components can all be of standard, commercially available types whose modes of operation are already well known.

BRIEF DESCRIPTION OF THE DRAWING

The sole FIGURE is a block diagram of a preferred embodiment of a monitoring and control system according to the invention.

DESCRIPTION OF THE PREFERRED EMBODIMENTS

The system shown in the FIGURE includes a measured value sensor, or pick-up, 1 which generates a voltage which is proportional, for example, to the pressure in the hydraulic circuit of the hydraulically driven compacting tool. Thus, sensor 1 can be a known hydraulic pressure sensor installed at a suitable location in the hydraulic drive circuit. The voltage produced by sensor 1 travels through a carrier frequency amplifier 2, a lowpass filter 3 and a matching amplifier 4 to a voltage/frequency converter 5. Carrier frequency amplifier 2 produces an alternating voltage of high frequency (~5 KHz) and is connected with sensor 1 by a bridge connection. If the sensor is under pressure a carrier frequency voltage is generated which is proportional to the pressure. This voltage is demodulated and transformed into a direct voltage in the amplifier 2. The direct voltage at the output of amplifier 2 is 1 Volt/30 bar. Lowpass filter 3 has a cutoff frequency of about 5 Hz and an attenuation of 40 dB/Decade and serves to suppress remainders of the carrier frequency from amplifier 2 and short-time disturbances of the pressure. Converter 5 generates an output signal at a frequency proportional to the measured pressure and that signal is fed, via a frequency divider 6, to a main register or counter 7, respectively. The divider 6 frequency divides the number of pulses at the output frequency of the voltage/frequency converter 5 over a given measuring period and thus forms the desired time integral average of the hydraulic circuit pressure. A timer 8 connected to the divider 6, which timer may be quartz controlled for example, controls the divider in such a manner that the number of input pulses to divider 6 is always divided by the actually set measuring period so that even if there exist differences in the measuring periods (for example 5 or 8 seconds) an integral average which can always be compared with other averages is fed to the counter 7.

In order to eliminate the influence of periods where the compacting tool is starting and other unstationary operating states which may occur, for example, when passing over a large rock, a differentiator may advisably be connected, as shown in the FIGURE, between the carrier frequency amplifier 2 and the lowpass filter 3. This differentiator monitors the rate of change in pressure, i.e. for example the pressure differential over time, dp/dt, and blocks meesured values lying outside of a given range of increasing dp/dt values from being processed until the interference has died out; thus, the measurement is delayed accordingly.

Removal, or cancellation, of the pressure component responsible for the reactive power in a pressure measured by measured value sensor 1 is effected by adding a corresponding interference value either directly behind the measured value sensor or at some other suitable point in the chain described above. Thus the counter 7 receives only those values which are actually representative of the effective power supplied to the soil. This addition of interference values can be omitted whenever the operating parameters of the compacting device remain the same during all passes so that the driving energy is directly proportional to the compacting power.

Depending on whether the compacting device is moving forward or in reverse, the main register 7 reads out the measured values either to a forward memory $V_1$ or to a reverse memory $R_1$.

These memories operate as preliminary memories and each has an associated subsequent memory $V_2$ or $R_2$, respectively. The preliminary memories as well as the subsequent memories are all connected to a common difference former 9.

A first display device 10 is also connected directly to the preliminary memories and a further display device 11 is connected to the difference former 9. In addition, a comparator 12 is connected to difference former 9.

The system operates as follows: Let it be assumed that the memories $V_1$ and $V_2$ are associated with forward movement and memories $R_1$ and $R_2$ are associated with reverse movement of the compacting device and that the first pass is in the forward direction. Let is further be assumed that an integral average formation of the incoming signals is effected in the main register 7 in such a way that for each pass only one signal will be called out of the main register.

Then the signal derived during the first forward pass is stored in memory $V_1$. The measured value signal derived during the second pass, when the machine is traveling in the reverse direction, is furnished to the memory $R_1$.

The third pass is again in the forward direction, i.e. it must be stored in memory $V_1$; however, before it is put in, the old measured value still in memory $V_1$ is first transferred to the subsequent memory $V_2$. Then, the difference between the measured values from the first pass and the third pass is formed in the difference former 9 and, if required, is displayed in the display device 11.

The fourth pass is a reverse pass, thus its measured value is stored in memory $R_1$, after the value from the second pass previously stored therein has been transferred to the subsequent memory $R_2$. Then the difference former 9 forms the difference between the measured values from the fourth and second passes.

With the next succeeding passes, this process is repeated correspondingly, with the addition that the measured value stored in the subsequent memory $R_2$ or $V_2$ is erased when a new measured value is put in.

With the increasing compaction of the soil, the differences between the measured values derived during successive passes in the same direction of movement become increasingly smaller. Finally, a state is reached where further passes are no longer worthwhile and where the reloosening of the soil, which would require renewed compaction, might occur.

In order to interrupt the compacting process at the right point in time, comparator 12 is operated to compare the difference between measured values, as determined by the difference former 9, with a given minimum value and when this minimum value is reached, or the difference falls below this minimum value, a signal is emitted. This signal may also be applied to actuate a speed regulator which increases the speed of the compacting device until the difference between measured values approximately corresponds to the given minimum value.

If a plurality of separately driven compacting tools with vibrating masses are combined in the compacting device, it is recommended, in order to attain greater accuracy, to separately measure the compacting power in each compacting tool, according to the invention.

While the FIGURE indicates that the tool, its hydraulic system and the speed controls are carried by the vehicle, it will be appreciated that the illustrated monitoring and control circuits will normally also be carried by the vehicle.

It will be appreciated that the manner of interconnecting and operating the memories and difference former is relatively simple and can be effected in any suitable manner well known in the art.

It will be understood that the above description of the present invention is susceptible to various modifications, changes and adaptations, and the same are intended to be comprehended within the meaning and range of equivalents of the appended claims.

What is claimed is:

1. In apparatus for monitoring the degree of compaction achieved by a compacting device including at least one vibrating compacting tool which device is mounted on a vehicle arranged to travel back and forth over a surface to be compacted, the apparatus including means for detecting the value of an operating parameter which has a known relationship to the effective power of the vibrating compacting tool during each pass of the vehicle over the surface and which is representative of the degree of compaction achieved, the improvement comprising:

representation storage means connected to said detecting means for separately storing representations of the detected values associated with each direction of travel of the vehicle;

and difference forming means connected to said storage means for providing a representation of the difference between detected values associated with successive passes of the vehicle in the same direction.

2. An arrangement as defined in claim 1 wherein said representation storage means comprise two memory units each connected to receive successive representations associated with a respective direction of movement of the vehicle, and each said unit is composed of a preliminary memory connected to store the representation associated with the most recent pass of the vehicle in its associated direction and a subsequent memory connected to store the representation associated with the pass immediately preceding the most recent pass of the vehicle in its associated direction.

3. An arrangement as defined in claim 2 wherein said memories of each said memory unit are interconnected for causing the representation stored in each said subsequent memory to be replaced by that previously stored in said preliminary memory at the time of read-in of a new representation to said preliminary memory.

4. An arrangement as defined in claim 1 further comprising a comparator connected to said difference forming means for comparing each difference representation with a representation of a given minimum difference value and producing an indication when the value represented by a difference representation lies below the minimum difference value.

5. An arrangement as defined in claim 4 further comprising means providing a signal for increasing the speed of travel of the vehicle when said comparator produces such an indication.

6. An arrangement as defined in claim 1 further comprising means for producing a signal to vary the amplitude of vibration of the compacting tool in a manner to maximize the difference between detected values associated with successive passes of the vehicle in the same direction.

7. An arrangement as defined in claim 1 wherein said detecting means produce a representation of the average value of the operating parameter during at least part of each pass of the vehicle.

8. An arrangement as defined in claim 1 wherein the tool is hydraulically driven, the hydraulic pressure applied to the tool is the operating parameter having a known relationship to the effective power of the tool, and said detecting means are arranged to provide an indication of the value of the hydraulic pressure applied to the tool compensated by the component of that pressure value consumed as reactive power within the hydraulic system.

9. An arrangement as defined in claim 1 wherein said detecting means comprises: a sensor connected for sensing the operating parameter value; a carrier frequency amplifier connected for amplifying the output produced by said sensor; a lowpass filter connected to the output of said amplifier; a matching amplifier connected to the output of said filter; a voltage/frequency converter connected to the output of said matching amplifier; a frequency divider having a signal input connected to the output of said converter and operated to produce a number of pulses proportional to the frequency of the output of said converter during each detecting operation; and a counter connected to count the number of pulses produced by said counter during each detecting operation, and said representation storage means comprise two memory units each connected to receive and store a representation of the count produced by said counter during travel of the vehicle in a respective direction, and said difference forming means are connected to said memory units to receive the representations stored in said memory units.

10. An arrangement as defined in claim 9 wherein said detecting means further comprise a differentiator connected for suppressing outputs produced by said sensor which represent operating parameter values that have a rate of change exceeding a predetermined value.

* * * * *